US011094497B2

(12) United States Patent
Liang et al.

(10) Patent No.: US 11,094,497 B2
(45) Date of Patent: Aug. 17, 2021

(54) X-RAY SOURCE TARGET

(71) Applicant: General Electric Company, Schenectady, NY (US)

(72) Inventors: Yong Liang, Niskayuna, NY (US); Vance Scott Robinson, Glenville, NY (US); Uwe Wiedmann, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 1166 days.

(21) Appl. No.: 15/442,132

(22) Filed: Feb. 24, 2017

(65) Prior Publication Data

US 2018/0247786 A1 Aug. 30, 2018

(51) Int. Cl.

| | |
|---|---|
| ***H01J 35/00*** | (2006.01) |
| ***H01J 35/10*** | (2006.01) |
| ***H01J 35/12*** | (2006.01) |

(52) U.S. Cl.

CPC ..... *H01J 35/105* (2013.01); *H01J 35/12* (2013.01); *H01J 2235/088* (2013.01); *H01J 2235/1291* (2013.01)

(58) Field of Classification Search

CPC ..... H01J 35/10; H01J 35/105

See application file for complete search history.

(56) References Cited

U.S. PATENT DOCUMENTS

| | | | | |
|---|---|---|---|---|
| 5,148,462 | A | 9/1992 | Spitsyn et al. | |
| 5,825,848 | A | 10/1998 | Virshup et al. | |
| 6,292,538 | B1 | 9/2001 | Hell et al. | |
| 2011/0058655 | A1 | 3/2011 | Okumura et al. | |
| 2014/0177800 | A1 | 6/2014 | Sato et al. | |
| 2014/0211919 | A1 | 7/2014 | Ogura et al. | |
| 2015/0092924 | A1* | 4/2015 | Yun | H01J 35/12 378/143 |
| 2015/0117616 | A1 | 4/2015 | Ishii et al. | |
| 2015/0194287 | A1 | 7/2015 | Yun et al. | |
| 2018/0033583 | A1* | 2/2018 | Olsen | H01J 35/08 |

OTHER PUBLICATIONS

Liu, Ge; "X-ray Diffraction from Thin Film Structures: Characterization and Modeling", 2007, Google Book, 129 pgs., https://books.google.com/books/about/x_ray_Diffraction_from_Thin_Film_Structu.html?id=q5DajwEACAAJ.

Uhlen, Fredrik, et al.; "New diamond nanofabrication process for hard x-ray zone plates", Journal of Vacuum Science & Technology B, vol. 29, Issue 6, pp. 1-4, https://www.kth.se/polopoly_fs/1.489905!/Uhlen, J. Vac. Sci. Technol_2011.pdf, Nov./Dec. 2011.

Nilsson, D., et al.; "Thermal stability of tungsten zone plates for focusing hard x-ray free-electron laser radiation", New Journal of Physics, vol. 14, pp. 1-9, https://www.kth.se/polopoly_fs/1.489891!/Nilsson_New_j_phys_2012.pdf, Apr. 11, 2012.

* cited by examiner

*Primary Examiner* — Dani Fox

(57) ABSTRACT

In one embodiment, an X-ray source includes a source target configured to generate X-rays when impacted by an electron beam. The source target includes one or more thermally conductive layers; and one or more X-ray generating layers interleaved with the thermally conductive layers, wherein at least one X-ray generating layer comprises regions of X-ray generating material separated by thermally conductive material within the respective X-ray generating layer.

18 Claims, 11 Drawing Sheets

X-RAY SOURCE TARGET

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

A variety of medical diagnostic, laboratory, security screening, and industrial quality control imaging systems, along with certain other types of systems (e.g., radiation-based treatment systems), utilize X-ray tubes as a source of radiation during operation. Typically, the X-ray tube includes a cathode and an anode. An electron beam emitter within the cathode emits a stream of electrons toward an anode that includes a target that is impacted by the electrons.

A large portion of the energy deposited into the target by the electron beam produces heat within the target, with another portion of the energy resulting in the production of X-ray radiation. Indeed, only about 1% of the energy from the electron beam X-ray target interaction is responsible for X-ray generation, with the remaining 99% resulting in heating of the target. The X-ray flux is, therefore, highly dependent upon the amount of energy that can be deposited into the source target by the electron beam within a given period of time.

However, the relatively large amount of heat produced during operation, if not mitigated, can damage the X-ray source (e.g., melt the target). Accordingly, conventional X-ray sources are typically cooled by either rotating or actively cooling the target. When rotation is the means of avoiding overheating, the amount of deposited heat along with the associated X-ray flux is limited by the rotation speed (RPM), target heat storage capacity, radiation and conduction cooling capability, and the thermal limit of the supporting bearings. Tubes with rotating targets also tend to be larger and heavier than stationary target tubes. When the target is actively cooled, such cooling generally occurs relatively far from the electron beam impact area, which in turn significantly limits the electron beam power that can be applied to the target. In both situations, the restricted heat removal ability of the cooling methods markedly lowers the overall flux of X-rays that are generated by the X-ray tube.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible embodiments. Indeed, the invention may encompass a variety of forms that may be similar to or different from the embodiments set forth below.

In one embodiment, an X-ray source includes a source target configured to generate X-rays when impacted by an electron beam. The source target includes one or more thermally conductive layers; and one or more X-ray generating layers interleaved with the thermally conductive layers, wherein at least one X-ray generating layer comprises regions of X-ray generating material separated by thermally conductive material within the respective X-ray generating layer.

In a second embodiment, an X-ray source includes a rotating target structure. The rotating target structure includes a base and one or more electron beam target tracks. The one or more electron beam target tracks include a source target material configured to generate X-rays when impacted by an electron beam. The source target includes one or more thermally conductive layers and one or more X-ray generating layers interleaved with the thermally conductive layers, wherein at least one X-ray generating layer comprises regions of X-ray generating material separated by thermally conductive material within the respective X-ray generating layer.

In a third embodiment, an X-ray source includes a rotating target structure. The rotating target structure includes one or more electron beam tracks. The one or more electron beam tracks include a material that generates X-rays when impacted by an electron beam. The rotating target structure further includes a cavity disposed below the one or more electron beam tracks and a phase change material within the cavity, wherein the phase change material is a solid at non-operational temperatures of the X-ray source and is a liquid at operational temperatures of the X-ray source.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
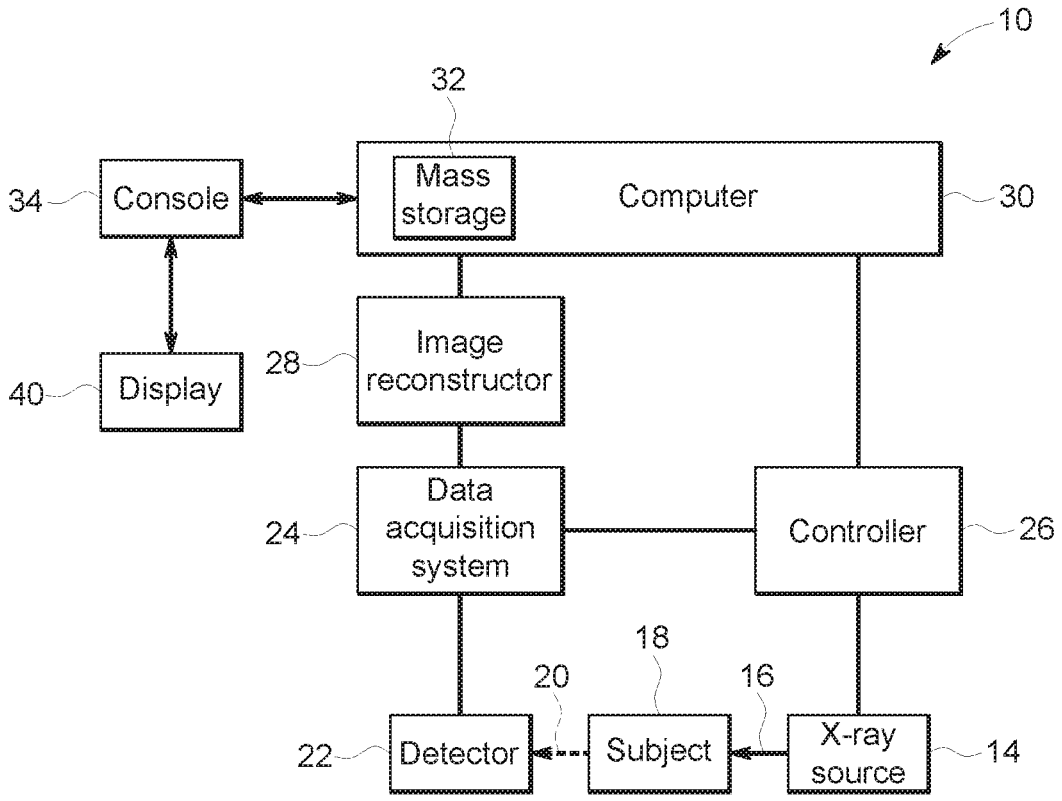
FIG. 1 is a block diagram of an X-ray imaging system, in accordance with aspects of the present disclosure.

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Furthermore, any numerical examples in the following discussion are intended to be non-limiting, and thus additional numerical values, ranges, and percentages are within the scope of the disclosed embodiments.

As noted above, the X-ray flux produced by an X-ray source may depend on the energy and intensity of an electron beam incident on the source's target region. The energy deposited into the target produces, in addition to the X-ray flux, a large amount of heat. Accordingly, during the normal course of operation, a source target is capable of reaching temperatures that, if not tempered, can damage the target. The temperature rise, to some extent, can be managed by convectively cooling, also referred to as "direct cooling", the target. However, such cooling is macroscopic and does not occur immediately adjacent to the electron beam impact area where damage i.e. melting, can occur. Without localized cooling, the overall flux of X-rays produced by the source is limited, potentially making the source unsuitable for certain applications, such as those requiring high X-ray flux densities. Rotating the target such that the electron beam distributes the energy over a larger area can reduce the target temperature locally but it typically requires larger evacuated volumes and the additional complexity of rotating components such as bearings. Further, vibrations and non-circularities associated with rotating targets become prohibitive for high resolution applications where the required spot size is on the order of the amplitude of the vibration. Accordingly, it would be desirable if the source could be operated in a substantially continuous basis in a manner that enables the output of high X-ray flux.

One approach for addressing thermal build-up is to use a layered X-ray source having one or more layers of islands or strips of X-ray generating material (e.g., tungsten) disposed in thermal communication with one or more layers of thermal-conduction material (e.g., diamond). The thermal-conduction materials that are in thermal communication with the X-ray generating materials generally have a higher overall thermal conductivity than the X-ray generating material. The one or more thermal-conduction layers may generally be referred to as "heat-dissipating" or "heat-spreading" layers, as they are generally configured to dissipate or spread heat away from the X-ray generating materials impinged on by the electron beam to enable enhanced cooling efficiency. In certain implementations, the interfaces between X-ray generating and thermal-conduction layers are roughened to improve adhesion and heat conduction between the adjacent layers. Having better thermal conduction within the source target (i.e., anode) allows the end user to operate the source target at higher powers or smaller spot sizes (i.e., higher power densities) while maintaining the source target at a target operational temperature or within an operational temperature range. Alternatively, the source target can be maintained at lower temperatures at the same X-ray source power levels, thus increasing the operational lifetime of the source target. The former option translates into higher throughput and better temporal resolution, as higher X-ray source power results in quicker measurement exposure times or improved feature detectability as smaller spot sizes results in smaller features being distinguishable. The latter option results in lower operational (variable) expenses for the end user as targets or tubes (in the case where the target is an integral part of the tube) will be replaced at a lower frequency.

One challenge for implementing such a multi-layered target is delamination, such as at the tungsten/diamond interface, due to weak adhesion and high stress levels between differing materials. Various approaches for improving adhesion between layers and/or reducing internal stress levels in a multi-layer X-ray target may be employed. For example, material density within a region of material may be graded (e.g., have a gradient stress or density profile) or otherwise varied, such as via varying deposition conditions to reduce internal stress. These effects may vary based on the deposition technique employed and the parameters, either constant or varied, during the deposition. For example, varying deposition parameters in chemical vapor deposition (CVD) and sputtering have varying degrees of influence on the stress and density of the deposited material. Thus, deposition technique and corresponding parameters may be selected so as to obtain the desired internal stress and/or density profile. For example, more energetic processes, such as sputtering or some forms of plasma CVD, can have a large effect on stress within the deposited material.

In addition, in some instances a layer or surface may be etched or otherwise roughened prior to deposition of a subsequent layer in order to improve adhesion between the differing materials. In addition, in certain implementations one or more interlayers (such as a carbide interlayer) may be deposited between X-ray generating and thermal-conduction layers to improve adhesion, such as to facilitate or provide chemical bonding. With respect to the various deposition steps discussed herein, any suitable deposition technique (e.g., ion-assisted sputtering deposition, chemical vapor deposition, plasma vapor deposition, electro-chemical deposition, and so forth) may be employed.

Multi-composition X-ray sources as discussed herein may be based on a stationary (i.e., non-rotating) anode structure or a rotating anode structure and may be configured for either reflection or transmission X-ray generation. As used herein, a transmission-type arrangement is one in which the X-ray beam is emitted from a surface of the source target opposite the surface that is subjected to the electron beam. Conversely, in a reflection arrangement, the angle at which X-rays leave the source target is typically acutely angled relative to the perpendicular to the source target. This effectively increases the X-ray density in the output beam, while allowing a much larger thermal spot on the source target, thereby decreasing the thermal loading of the target.

By way of an initial example, in one implementation an electron beam passes through a thermally-conductive, radio-transparent material (e.g., a diamond layer or region) and is preferentially absorbed by an underlying X-ray generating (e.g., tungsten) material. Alternatively, in other implementations an X-ray generating material may be impacted first, with a thermally-conductive layer underneath. In both instances, additional alternating or interleaved regions of X-ray generating and thermally-conductive material may be provided as a stack within the X-ray source target (with either the X-ray generating material, thermally-conductive material, or a combination of materials on top), with successive and/or alternating regions adding X-ray generation and thermal conduction capacity. As will be appreciated, the thermally conductive and X-ray generating regions do not need to be the same thickness (i.e., height) with respect to the same or differing regions. That is, regions of the same type or of different types may differ in thickness from one another. The final layer on the target can be either an X-ray generating layer, a thermally-conductive layer, or a combination, as discussed herein.

With the preceding in mind, and referring to FIG. 1, components of an X-ray imaging system 10 are shown as including an X-ray source 14 that projects a beam of X-rays 16 through a subject 18 (e.g., a patient or an item undergoing security, industrial inspection, or quality control inspection). A beam-shaping component or collimator may also be provided in the system 10 to shape or limit the X-ray beam 16 so as to be suitable for the use of the system 10. It should be noted that the X-ray sources 14 disclosed herein may be used in any suitable imaging context or any other X-ray implementation. By way of example, the system 10 may be, or be part of, a fluoroscopy system, a mammography system, an angiography system, a standard radiographic imaging system, a tomosynthesis or C-arm system, a computed tomography system, and/or a radiation therapy treatment system. Further, the system 10 may not only be applicable to medical imaging contexts, but also to various inspection systems for material characterization, industrial or manufacturing quality control, luggage and/or package inspection, and so on. Accordingly, the subject 18 may be a laboratory sample, (e.g., tissue from a biopsy), a patient, luggage, cargo, manufactured parts, nuclear fuel, or other material of interest.

The subject may, for example, attenuate or refract the incident X rays 16 and produce the projected X-ray radiation 20 that impacts a detector 22, which is coupled to a data acquisition system 24. It should be noted that the detector 22, while depicted as a single unit, may include one or more detecting units operating independently or in conjunction with one another. The detector 22 senses the projected X-rays 20 that pass through or off of the subject 18, and generates data representative of the radiation 20. The data acquisition system 24, depending on the nature of the data generated at the detector 22, converts the data to digital signals for subsequent processing. Depending on the application, each detector 22 produces an electrical signal that may represent the intensity and/or phase of each projected X-ray beam 20. While the depicted system 10 depicts the use of a detector 22, in certain implementations the produced X-rays 16 may not be used for imaging or other visualization purposes and may instead be used for other purposes, such as radiation treatment of therapy. Thus, in such contexts, no detector 22 or data acquisition subsystems may be provided.

An X-ray controller 26 may govern the operation of the X-ray source 14 and/or the data acquisition system 24. The controller 26 may provide power and timing signals to the X-ray source 14 to control the flux of the X-ray radiation 16, and to control or coordinate with the operation of other system features, such as cooling systems for the X-ray source, image analysis hardware, and so on. In embodiments where the system 10 is an imaging system, an image reconstructor 28 (e.g., hardware configured for reconstruction) may receive sampled and digitized X-ray data from the data acquisition system 24 and perform high-speed reconstruction to generate one or more images representative of different attenuation, differential refraction, or a combination thereof, of the subject 18. The images are applied as an input to a processor-based computer 30 that stores the image in a mass storage device 32.

The computer 30 also receives commands and/or scanning parameters from an operator via a console 34 that has some form of operator interface, such as a keyboard, mouse, voice activated controller, or any other suitable input apparatus. An associated display 40 allows the operator to observe images and other data from the computer 30. The computer 30 uses the operator-supplied commands and parameters to provide control signals and information to the data acquisition system 24 and the X-ray controller 26.

Figure 2:
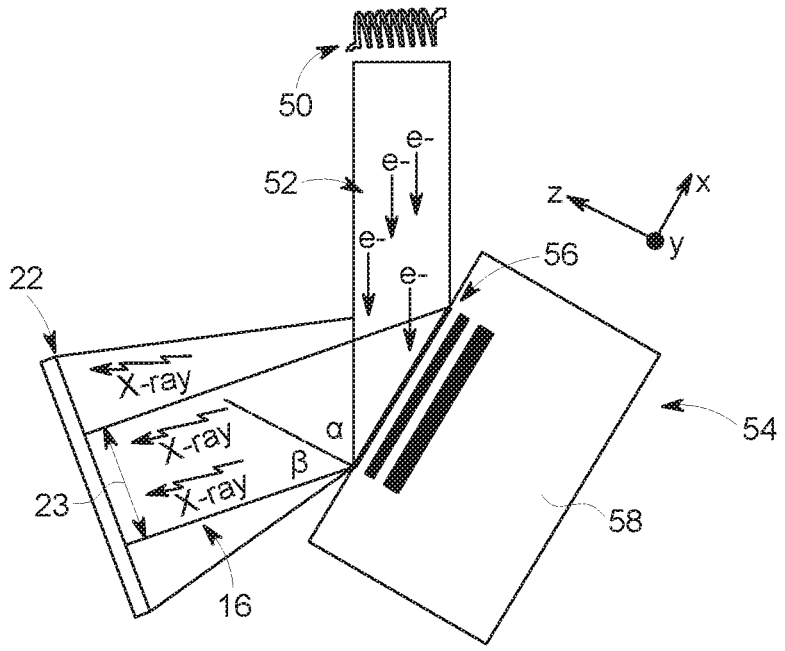
FIG. 2 depicts a generalized view of a multi-layer X-ray source and detector arrangement, in accordance with aspects of the present disclosure.

Referring now to FIG. 2, a high level view of components of an X-ray source 14, along with detector 22, are depicted. The aspects of X-ray generation shown are consistent with a reflective X-ray generation arrangement that may be consistent with either a rotating or stationary anode. In the depicted implementation, an X-ray source includes an electron beam emitter (here depicted as an emitter coil 50) that emits an electron beam 52 toward a target region containing X-ray generating material. The X-ray generating material may be a high-Z material, such as tungsten, molybdenum, titanium-zirconium-molybdenum alloy (TZM), rhodium, tungsten-rhenium alloy, copper-tungsten alloy, chromium, iron, cobalt, copper, silver, or any other material or combinations of materials capable of emitting X-rays when bombarded with electrons). The source target may also include one or more thermally-conductive materials, such as substrate 58, or thermally conductive layers or other regions surrounding and/or separating layers containing the X-ray generating material. As used herein, a region or layer 56 that includes X-ray generating material may be generally described as being an X-ray generating layer of the source target, where the X-ray generating layer has some corresponding thickness, which may vary between different X-ray generating layers within a given source target. As discussed herein, the layers 56 that contain X-ray generating material may be discontinuous in structure, with regions of thermally-conductive material interspersed, or otherwise present, within a given layer.

The electron beam 52 incident on a layer 56 containing X-ray generating material generates X-rays 16 that are directed toward the detector 22 and which are incident on the detector 22, the optical spot 23 being the area of the focal spot projected onto the detector plane. The electron impact area on the X-ray generating material may define a particular shape, thickness, or aspect ratio on the source target (i.e., anode 54) to achieve particular characteristics of the emitted X-rays 16. For example, the emitted X-ray beam 16 may have a particular size and shape that is related to the size and shape of the electron beam 52 when incident on the X-ray generating material. Accordingly, the X-ray beam 16 exits the source target 54 from an X-ray emission area that may be predicted based on the size and shape of the impact area. In the depicted example the angle between the electron beam 52 and the normal to the target is defined as α. The angle β is the angle between the normal of the detector and the normal to the target. Where b is the thermal focal spot size at the target region and c is optical focal spot size, b=c/cos β. Further, in this arrangement, the equivalent target angle is 90-β.

As discussed herein, certain implementations employ a multi-layer source target 54 having two or more layers that contain X-ray generating material in the depth or z-dimension (i.e., two or more layers incorporating the X-ray generating material) separated by respective thermally conductive material in one or more dimensions. Such a multi-composition source target 54 may be fabricated using any suitable technique, such as suitable semiconductor manufacturing techniques including vapor deposition (such as chemical vapor deposition (CVD), sputtering, atomic layer deposition), chemical plating, ion implantation, or additive or reductive manufacturing, and so on. In particular, certain fabrication approaches discussed herein may be utilized to make a multi-layer source target 54.

Referring again to FIG. 2, generally the thermally conductive regions are configured to conduct heat away from the X-ray generating volume during operation. That is, the thermal materials discussed herein have thermal conductivities that are higher than those exhibited by the X-ray generating material. By way of non-limiting example, a thermal-conducting layer may include carbon-based materials including but not limited to highly ordered pyrolytic graphite (HOPG), diamond, and/or metal-based materials such as beryllium oxide, silicon carbide, copper-molybdenum, copper, tungsten-copper alloy, or any combination thereof. Alloyed materials such as silver-diamond may also be used. Table 1 below provides the composition, thermal conductivity, coefficient of thermal expansion (CTE), density, and melting point of several such materials.

TABLE 1

| Material | Composition | Thermal Conductivity W/m-K | CTE ppm/K | Density g/cm$^3$ | Melting point ° C. |
|---|---|---|---|---|---|
| Diamond | Polycrystalline diamond | ≥1800 | 1.5 | 3.5 | NA* |
| Beryllium oxide | BeO | 250 | 7.5 | 2.9 | 2578 |
| CVD SiC | SiC | 250 | 2.4 | 3.2 | 2830 |
| Highly oriented pyrolytic graphite | C | 1700 | 0.5 | 2.25 | NA* |
| Cu—Mo | Cu—Mo | 400 | 7 | 9-10 | 1100 |
| Ag-Diamond | Ag-Diamond | 650 | <6 | 6-6.2 | NA* |
| OFHC | Cu | 390 | 17 | 8.9 | 1350 |

*Diamond or HOPG graphitizes at ~1,500° C., before melting, thus losing the thermal conductivity benefit. In practice, this may be the limiting factor for any atomically ordered carbon material instead of melting.

It should be noted that the different thermally-conductive layers, structures, or regions within a source target 54 may have correspondingly different thermally-conductive compositions, different thicknesses, and/or may be fabricated differently from one another, depending on the respective thermal conduction needs at a given region within the source target 54. However, even when differently composed, such regions, if formed so as to conduct heat from the X-ray generating materials, still constitute thermally-conductive layers or regions as used herein. For the purpose of the examples discussed herein, diamond is typically referenced as the thermally-conductive material. It should be appreciated however that such reference is merely employed by way of example and to simplify explanation, and that other suitable thermally-conductive materials, including but not limited to those listed above, may instead be used as a suitable thermally-conductive material.

In various implementations respective depth (in the z-dimension) within the source target 54 may determine the thickness of an X-ray generating region found at that depth, such as to accommodate the electron beam incident energy expected at that depth. That is, X-ray generating regions at different depths within a source target 54 may be formed so as to have different thicknesses. Similarly, depending on heat conduction requirements at a given depth, the differing thermal-conductive layers may also vary in thickness, either based upon their depth in the source target 54 or for other reasons related to optimizing heat flow and conduction.

Figure 3:
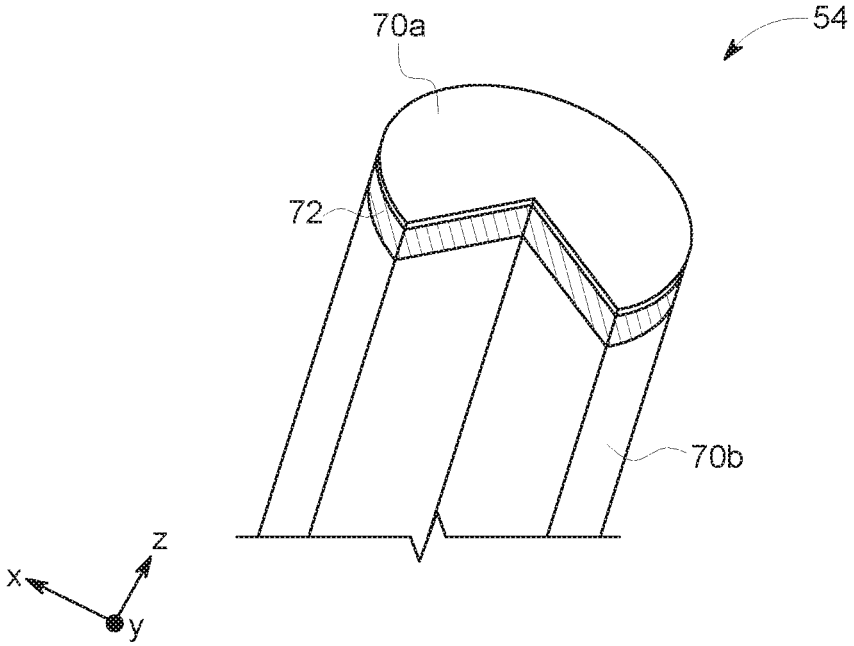
FIG. 3 depicts a cut-away perspective view of a layered X-ray source, in accordance with aspects of the present disclosure.

By way of example of these concepts, FIG. 3 depicts a partial-cutaway perspective view of a stationary X-ray source target (i.e., anode) 54 having alternating layers, in the z-dimension, of: (1) a first thermally-conductive layer 70*a* (such as a thin diamond film, approximately 0 to 15 μm in thickness) on face of the source target 54 to be impacted by the electron beam 52; (2) a layer 72 containing X-ray generating material (i.e., a high-Z material, such as a tungsten layer approximately 10 to 40 μm in thickness), possibly interspersed with thermally-conductive material or regions within the layer 72; and (3) a second thermally-conductive layer 70*b* (such as a diamond layer or substrate approximately 1.2 mm in thickness) underlying the layer 72. It should be noted that, in other implementations, layer (1) is optional and may be omitted (i.e., thickness of 0), making the layer 72 containing X-ray generating material the top layer of the source target 54. As discussed herein, the X-ray generating material within the layer 72 may be discontinuous throughout the layer 72. Further, the example of FIG. 3 depicts only a single layer 72 containing X-ray generating material, though the single layer is part of a multi-layer source target 54 in that the layer 72 is sandwiched between two thermal-conduction layers 70*a* and 70*b*.

As noted above, one issue in fabricating and using multi-layer X-ray source targets 54 is the delamination of different layers of the source target 54. To address these delamination issues, adhesion between X-ray generating layers (e.g., tungsten layers) and thermal-conduction layers (e.g., diamond layers) may be improved via one or more of mechanical or structural approaches, chemical approaches, and/or use of one or more interface layers. By way of example, mechanical adhesion improvements may include increasing surface area of the X-ray generating layer (e.g., tungsten) for a higher degree of interlocking at the micrometer-level between the X-ray generating and thermal conduction layers.

In other approaches, an interface layer may be optionally provided between X-ray generating and thermally-conductive layers to promote bonding between the layers. For example, improved bonding between diamond and tungsten layers may be accomplished by depositing a thin carbide layer, such as tungsten carbide, between tungsten and diamond layers. In such an approach, the carbide interlayer provides a chemical bonding of the diamond and tungsten layers and serves as a barrier layer that limits the interdiffusion of tungsten and carbon. The tungsten carbide layer can be formed by treating the tungsten surface in a carbon rich environment at high temperatures, by depositing diamond on a tungsten layer at high temperatures using a CVD method, for example, or by post-deposition annealing. In an example of such an approach, it may be desirable that the tungsten carbide layer has the tungsten carbide stoichiometry with a thickness of approximately 100 nm to minimize local heating. In addition to tungsten carbide, other carbides such as silicon carbide, titanium carbide, tantalum carbide, and so forth can be used to improve adhesion between tungsten and diamond layers.

In addition, in certain implementations a non-carbide interlayer can be deposited or formed on the carbide interlayer to further limit carbide growth at the interface. The attributes of this non-carbide interlayer, when present, are ductile behavior (by itself or alloyed with tungsten) and little or no carbide formation in a carbon rich environment. Examples of materials suitable for forming such a non-carbide interlayer include, but are not limited to: rhenium, platinum, rhodium, iridium, and so forth.

Figure 4:
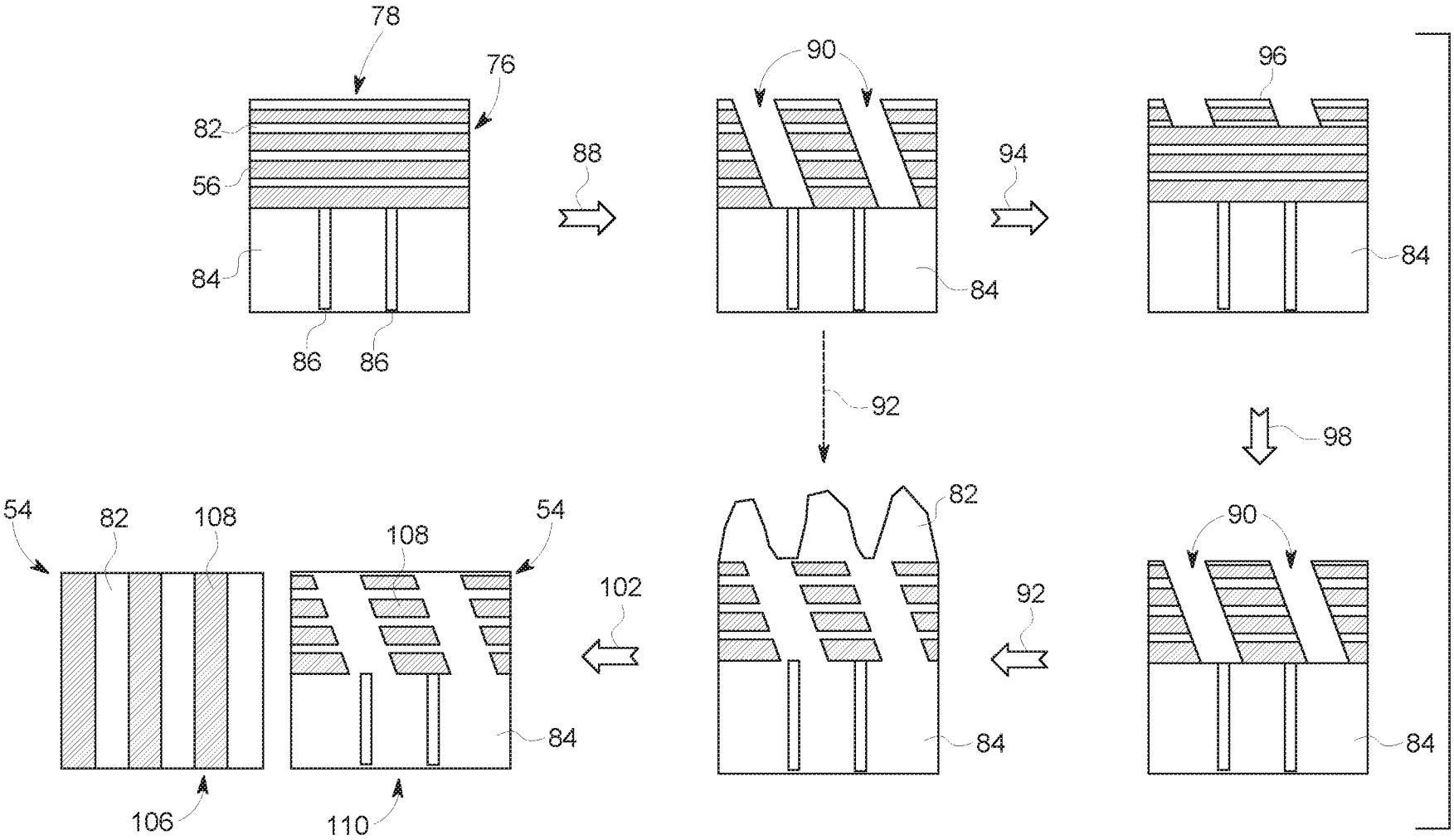
FIG. 4 depicts a process flow of fabrication of a multi-layer source target having angled discretized tungsten strips, in accordance with aspects of the present disclosure.
Figure 5:
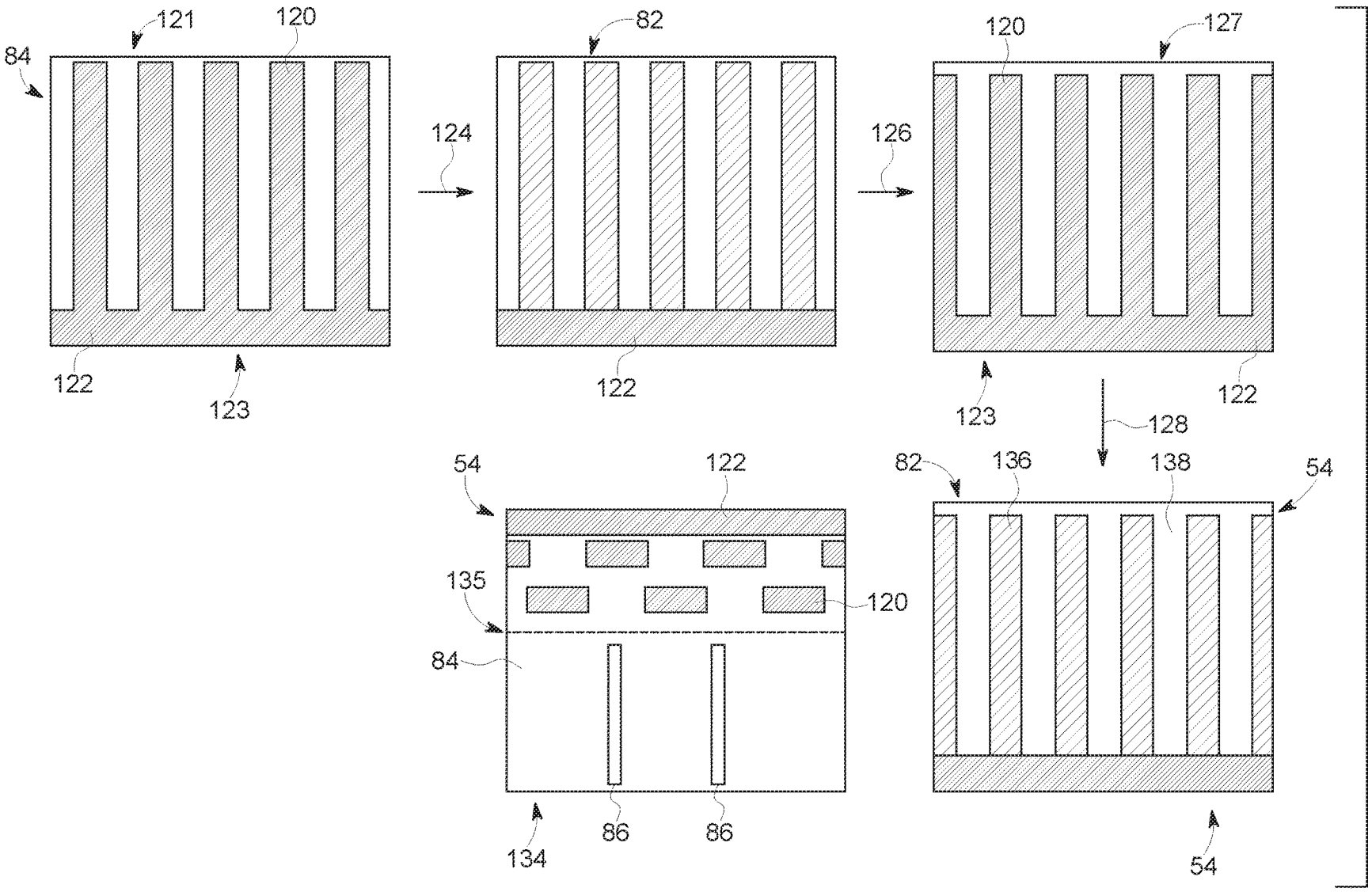
FIG. 5 depicts a process flow of fabrication of a multi-layer source target having discretized tungsten strips, in accordance with aspects of the present disclosure.

With the preceding in mind, the present approach relates, in part, to providing discontinuous layers or regions of X-ray generating material within a source target to improve heat dissipation, such as by providing additional direction through which heat can be dissipated. Turning to the figures, FIGS. 4 and 5 depict two process views showing fabrication of multi-layer source targets having strips of discretized tungsten. In one implementation, the two fabrication processes use laser ablation, masking and deposition, or film deposition and etching to create a source target 54 having discretized tungsten strips in diamond (or other suitable X-ray generating material surrounded by thermally-conductive material).

In the present examples, FIG. 4 shows fabrication steps for fabricating a multi-layer source target 54 having angled stacks of angled discretized X-ray generating tungsten strips 108. The angled discretized tungsten strips 108 enable greater lateral coverage of X-ray generating tungsten as seen from above (i.e., the direction of approach of the electron beam), while enabling more efficient heat dissipation to the surrounding thermally conductive diamond. In this process example, at the first step, a layered tungsten 56 and diamond 82 stack 76 is provided. In the illustrated embodiment, the stack 76 has four alternating layers of each of the X-ray generating tungsten 56 and the thermally conductive diamond 82. However, there may be any number of layers (e.g., 2, 3, 4, 5, or more) of each of the X-ray generating tungsten 56 and the thermally conductive diamond 82 provided. The layers of X-ray generating tungsten 56 at different depths within the stack 76 may have different thicknesses, such as to accommodate the electron beam incident energy expected at particular depths. Similarly, depending on heat conduction requirements at a particular depth, the layers of thermally conductive diamond 82 may also vary in thickness. Further, the alternating layers may increase in thickness as they move downward (in the z-dimension) from a top surface 78 of the stack 76, so as to provide more even heat dissipation. Further, the stack 76 may also have a thicker diamond substrate layer 84 on the bottom and may have alignment keys 86 on the edge of the diamond substrate layer 84. There may be any number of alignment keys 86 (e.g., 1, 2, 3 or more) on opposing sides of the stack 76 that may protrude from the surface or indent into the surface of the diamond substrate layer 84. The alignment keys 86 may be used to hold the stack 76 in place during the fabrication process and/or to connect separate pieces of discretized tungsten multi-layer source target together in multi-piece assemblies, as discussed in more detail with regard to FIG. 10.

At step 88 of the depicted example, laser ablation is used to ablate wells 90 into the alternating tungsten 56 and diamond 82 stack 76 off normal (i.e., not perpendicular) to the top surface 78 and to the layers themselves. The laser may ablate the tungsten 56 and diamond 82 layers down to the diamond substrate layer 84. In the step 92 the ablated wells 90 are filled with diamond (or other suitable thermally conductive material). However, if the laser does not ablate the tungsten layers 56 sufficiently, a step 94 uses the ablated diamond 96 as a mask for etching of the tungsten layers 56. Steps 88 (ablation) and 94 (using ablated diamond as a mask for tungsten etching) are repeated in the next step 98 until the alternating layers are ablated creating the wells 90 down to the diamond substrate layer 84. In the depicted step 92, the wells 90 are filled with thermally conductive diamond 82 using a CVD (chemical vapor deposition) method, such as plasma enhanced CVD or hot-filament CVD. If desired, planarization of the deposited diamond may be performed in a final step 102.

The resulting source target 54 contains angled discretized tungsten strips 80, with ends that may be shaped as rhombi having opposite equal acute angles and opposite equal obtuse angles, disposed in thermally conductive diamond 56. Angled discretized tungsten strips 108 in diamond 82 enable more efficient heat dissipation immediately around the X-ray generating tungsten 56. Creating wells 90 at an angle off normal to the top surface 78 of the layered stack 76 results in angled stacks of angled discretized tungsten strips 108, as depicted in a side view 110. From a top surface view 106, the angled discretized tungsten strips 108 in diamond 82 may appear as stripes of tungsten strips 108 and diamond 82. However, in the area of the top surface 78 where there appears to only be thermally conductive diamond 82, layers of X-ray generating tungsten 56 at depths below the surface 78 may gradually extend into these areas enabling greater than 70%, 80%, or 90%, or approximately 100% lateral coverage of X-ray generating tungsten 56 as seen by an electron beam that may impact the source target 54. The angled strips of discretized tungsten 108 in diamond 82 enable heat dissipation up and down (in the z-dimension) and left and right (in the x-dimension).

FIG. 5 depicts a top view of a process flow suitable for fabricating a multi-layer source target having isolated discretized tungsten strips 120 in thermally conductive diamond 82 involving masking and deposition. In this process example, at the first step, a diamond substrate layer 84 is provided having a layer of discretized tungsten strips 120 on top of the diamond substrate layer 84. There may be alignment keys 86 on the edge of the diamond substrate layer, as discussed above. These discretized tungsten strips 120 may be formed by masking and depositing the strips 120 of tungsten 56 onto a top surface 121 of the diamond substrate layer 84. A contact layer 122 may be deposited with the discretized tungsten strips 120, such that the contact layer 122 may run perpendicular to the strips 120 along an edge 123 of the diamond substrate layer 84. The contact layer 122 may be made from tungsten and may be configured to provide a connection between each of the discretized tungsten strips 120 for conduction. The discretized tungsten strips 120 may also be formed on the top surface 121 of the diamond substrate layer 84 via film deposition and etching and or laser ablation of the deposited tungsten 56 and/or 3-D printing. Physical or chemical vapor deposition, such as sputtering, e-beam evaporation, or CVD, may be used for tungsten deposition.

At step 124, a layer of diamond 82 may be deposited on top of the discretized tungsten strips 120 such that the diamond 82 fills in the spaces between the discretized tungsten strips 120. The diamond 82 may be deposited such that the contact layer 122 remains exposed and not covered by the diamond 82. The diamond 82 may be deposited using a CVD method, such as plasma enhanced CVD or hot-filament CVD. Planarization of the diamond 82 layer may be performed creating a smooth or polished top surface of the diamond 82, if desired. In a next step 126, masking and deposition of another layer of discretized tungsten strips 120 may be deposited onto a top surface 127 of the previously deposited diamond 82. The discretized tungsten strips 120 may be deposited such that they are adjacent in position to the previously deposited strips and therefore may not be directly over the positions of the layer of strips below. Placement of the new layer of tungsten strips 120 adjacent to the previously layer of tungsten strips 120 may enable creating a source target with discrete tungsten strips 120 and approximately 100% lateral coverage of X-ray generating tungsten 56 as seen by an electron beam that may impact the source target 54. The contact layer 122 may be deposited with the discretized tungsten strips 120 as previously discussed, such that that the contact layer 122 may run perpendicular to the strips 120 along the edge 123. In a next step 128, a layer of diamond 82 may be deposited on top of the discretized tungsten strips 120 such that the diamond fills in the spaces between the discretized tungsten strips 120. The diamond 82 may further be deposited such that the contact layer 122 remains exposed and not covered by the diamond 82. As before, planarization of the diamond 82 layer may be performed creating a smooth or polished top surface of the diamond 82, if desired. This process of masking and deposition of discretized tungsten strips 120 adjacent to the layer of tungsten strips 120 below and deposition of diamond 82 between and over the strips 120 may be repeated until the desired source target 54 structure is achieved.

The resulting source target 54 contains discretized tungsten strips 120 disposed in thermally conductive diamond 82. Discrete strips of tungsten 120 in diamond 82 enable more efficient heat dissipation immediately around the X-ray generating tungsten 56. The tungsten strips 120 in diamond 82 may enable heat dissipation up and down (in the z-dimension) and left and right (in the x-dimension). From a side view 134, the discretized tungsten strips 120 in diamond 82 may appear as alternating rectangles, or a checkerboard pattern, as a result of depositing tungsten strips adjacent to the previously deposited strips in each cycle of the fabrication steps. The thickness of the tungsten strips 120 and the thickness of the diamond 82 may increase moving downward (in the z-dimension) from the top surface 124 to the diamond substrate layer 84 helping to distribute heat more evenly. In certain embodiments, the contact layer 122 may extend down to line 135 to the top of the diamond substrate layer 84 creating contact between the discretized tungsten strips 120. From a top view 132, the discretized tungsten strips 120 may appear as alternating strips at varying depths. There may be areas 136 where there are tungsten strips at a depths close to the surface, with only a layer thin layer of diamond covering the tungsten strips. There may also be areas 138 where there are tungsten strips at a depth farther from the surface, with a thicker layer of diamond covering the tungsten strips. In this manner, having strips of tungsten 120 (e.g., X-ray generating material) at varying depths throughout the source target may enable greater than 70%, 80%, 90% or approximately 100% lateral coverage of tungsten 56 as see by an electron beam that may impact the source target 54. Approximately 100% lateral coverage of X-ray generating tungsten 56 may enable maximizing X-ray emission.

Figure 6:
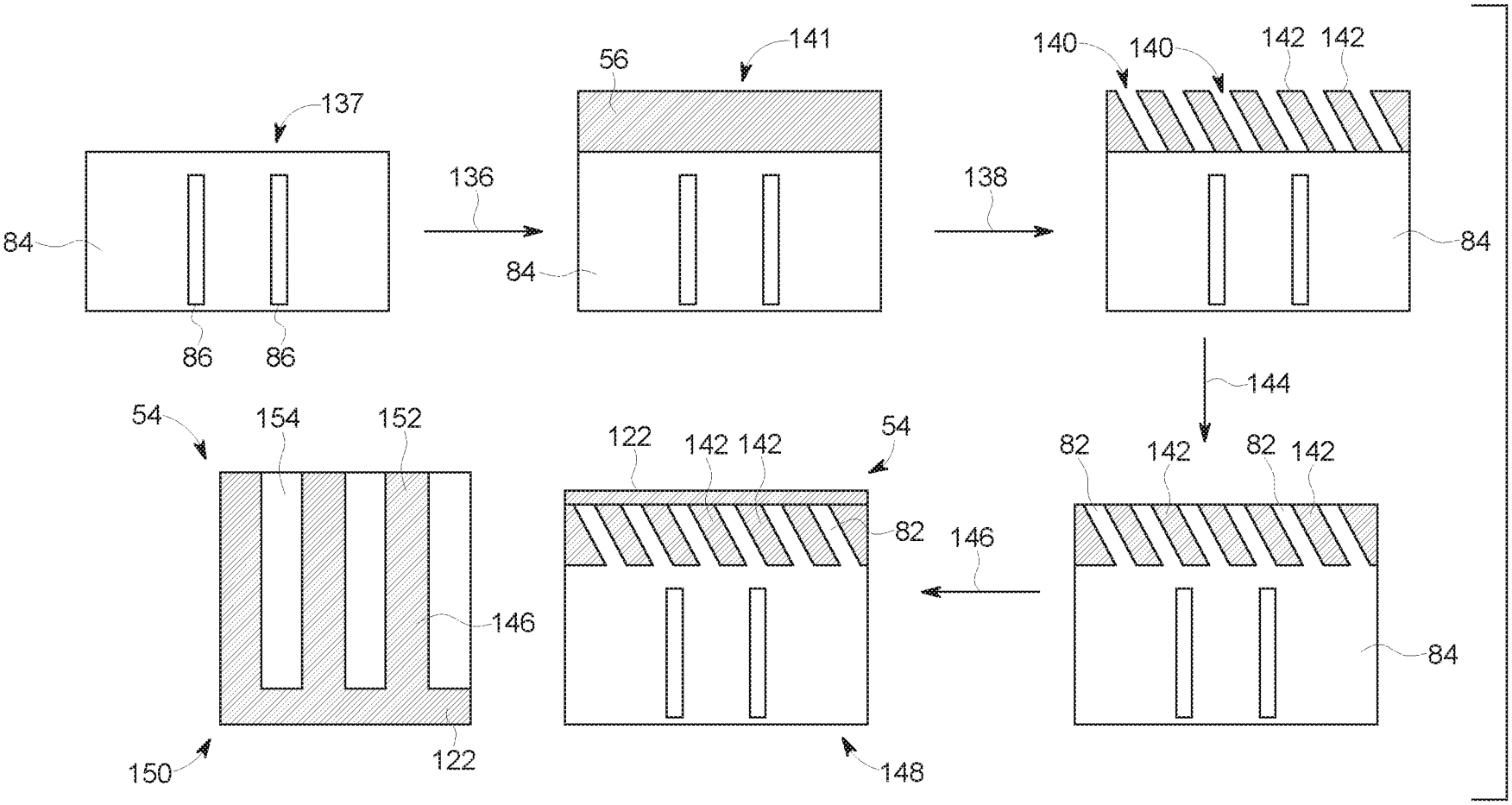
FIG. 6 depicts a process flow of fabrication of a multi-layer source target having angled discretized tungsten walls, in accordance with aspects of the present disclosure.

FIG. 6 depicts a process flow suitable for fabricating a multi-layer source target 54 having discretized X-ray generating tungsten walls 142 disposed in thermally conductive diamond 82. In this process example, at a first step, a diamond substrate layer 84 is provided. There may be any number of alignment keys 86 (e.g., 1, 2, 3 or more) disposed on opposing sides of the diamond substrate layer 84 that may protrude from the surface or indent into the surface of the diamond substrate layer 84. The alignment keys 86 may be used to hold the stack 158 in place during the fabrication process and/or to connect separate pieces of discretized tungsten multi-layer source target together in multi-piece assemblies, as discussed in more detail with regard to FIG. 10.

At step 136, a thick layer of tungsten 56 is deposited onto a top surface 137 of the diamond substrate layer 84 using film deposition. Physical or chemical vapor deposition, such as sputtering, e-beam evaporation, or CVD, may be used for tungsten deposition. In a next step 138, selective dry etching or laser ablation of the tungsten 56 layer may be used to create angled wells 140 from the top surface 141 of the tungsten layer down to the surface 137 of the diamond substrate layer 84. As in the illustrated embodiment, the wells 140 may be etched or ablated at an angle off normal to the top surface 141 of the tungsten 56 layer, thereby creating angled tungsten walls 142. However, the wells 140 may be etched or ablated at an angle perpendicular to the top surface 141 of the tungsten 56 layer, thereby creating straight tungsten walls. In certain embodiments, 3-D printing may be used to deposit the tungsten walls 142 without etching or ablation of the tungsten 56. In a next step 144, diamond 82 may be deposited into the wells 140, such that the diamond 82 fills only the wells 140 between the tungsten walls 142. However, the diamond 82 may be deposited such that there is a thin layer of diamond covering the top surface 141 of the tungsten walls 142. The diamond 82 may be deposited using a CVD method, such as plasma enhanced CVD or hot-filament CVD. Planarization of the diamond 82 layer may be performed creating a smooth or polished top surface of the diamond 82, if desired. In a next step 146, a contact layer 122 of tungsten 56 may be deposited such that the contact layer 122 runs perpendicular to the top surfaces 141 of the angled tungsten walls 142 and may be configured to provide a connection between each of the tungsten walls 142 for conduction.

The resulting source target 54 may contain angled discretized tungsten walls 142 disposed in thermally conductive diamond 82 enabling more efficient heat dissipation immediately around the X-ray generating tungsten walls 164. As depicted in a side view 148, the resulting angled tungsten walls 164 in diamond 82 may appear as angled vertical stripes of tungsten 56 and diamond 82, with a diamond substrate layer 84 below and a tungsten contact layer 122 above. From a top surface view 150, the angled discretized tungsten walls 142 in diamond 82 may appear as stripes of tungsten 56 and diamond 82. The walls of discretized tungsten 142 in diamond 82 may enable additional heat dissipation left and right (in the x-dimension). There may be areas 152 where the top of the tungsten walls 142 are at the surface or are close to the surface, with only a layer thin layer of diamond covering the tungsten walls. However, in the areas 154 of the top surface where there appears to only be thermally conductive diamond 82, layers of X-ray generating tungsten 56 at depths below the surface 78 may gradually extend into these areas due to the angled structure of the tungsten walls 142. This may enable greater than 70%, 80%, 90%, or approximately 100% lateral coverage of X-ray generating tungsten 56 as seen by an electron beam that may impact the source target 54. Approximately 100% lateral coverage of X-ray generating tungsten 56 may enable maximizing X-ray emission.

Figure 7:
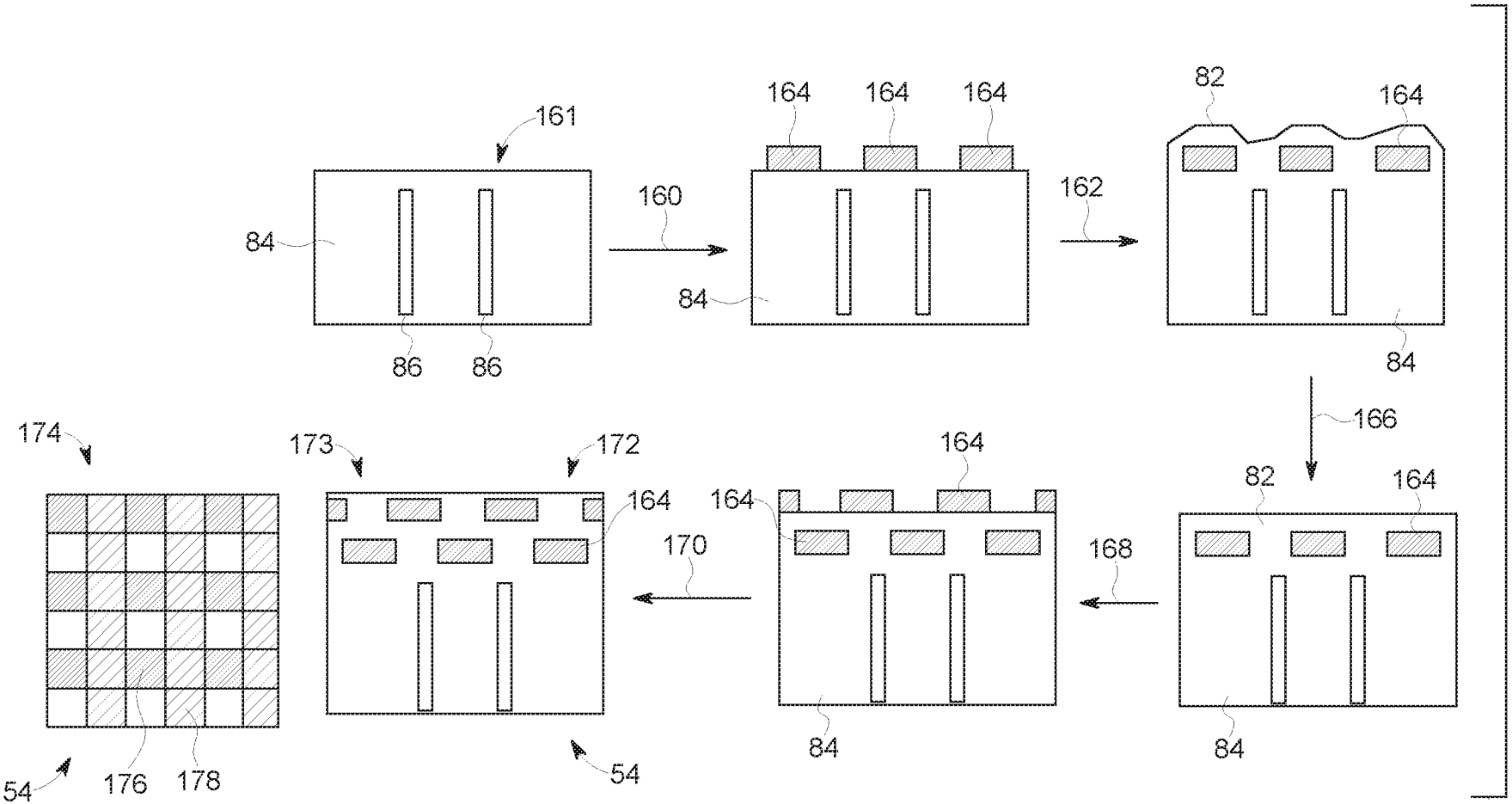
FIG. 7 depicts a process flow of fabrication of a multi-layer source target having discretized tungsten islands, in accordance with aspects of the present disclosure.

FIG. 7 depicts a process flow suitable for fabricating a multi-layer source target 54 having discretized X-ray generating tungsten islands 164 disposed in thermally conductive diamond 82. At a first step a diamond substrate layer 84 is provided. The diamond substrate layer 84 may have alignment keys 86 along the edge, as previously discussed. At a next step 160, discretized tungsten islands may be deposited onto a top surface 161 of the diamond substrate layer 84 using a combination of masking and deposition of tungsten islands 164, a combination of tungsten film deposition and etching of the tungsten 56, and/or 3-D printing of the tungsten islands 164. In a next step 162, diamond 82 may be deposited over the tungsten islands 164 such that the diamond 82 fills the spaces between the tungsten islands 164 and creates and overcoat above the tungsten islands. The diamond 82 may be deposited using a CVD method, such as plasma enhanced CVD or hot-filament CVD. In a next step 166, planarization of the deposited diamond may be performed to create a smooth or polished diamond surface, if desired.

In a next step 168, tungsten islands 164 may again be deposited onto the surface of the deposited diamond 82 using a combination of masking and deposition of tungsten islands 164, a combination of tungsten film deposition and etching of the tungsten 56, and/or 3-D printing of tungsten islands 164. These tungsten islands 164 may be deposited at positions adjacent to the previously deposited tungsten islands 164. Placement of the new layer of tungsten islands 164 adjacent to the previously layer of tungsten islands 164 may enable creating a source target with discrete tungsten islands 164 and approximately 100% lateral coverage of X-ray generating tungsten 56 as seen by an electron beam that may impact the source target 54. In a next step 170, diamond 82 may again be deposited over the tungsten islands 164 such that the diamond 82 fills the spaces between the tungsten islands 164 and creates and overcoat above the tungsten islands. Planarization of the deposited diamond may be performed to create a smooth or polished diamond surface, if desired. This process of deposition of discretized tungsten islands 164 adjacent to the layer of tungsten islands 164 below and deposition of diamond 82 between and over the islands 164 may be repeated until the desired source target 54 structure is achieved.

The resulting source target 54 contains discretized tungsten islands 164 disposed in thermally conductive diamond 82. Discrete islands of tungsten 164 in diamond 82 may enable more efficient heat dissipation immediately around the X-ray generating tungsten 56. The tungsten islands 164 in diamond 82 enable heat dissipation up and down (in the z-dimension) and left and right (in the x-dimension). From a side view 172, the discretized tungsten islands 164 in diamond 82 may appear as alternating rectangles, or a checkerboard pattern, as a result of depositing tungsten islands adjacent to the previously deposited islands in each cycle of the fabrication steps. The thickness of the tungsten islands 164 and the thickness of the diamond 82 may increase moving downward (in the z-dimension) from the top surface 173 to the diamond substrate layer 84 helping to distribute heat more evenly. From a top view 174, the discretized tungsten islands 164 may appear as alternating islands at varying depths. There may be areas 176 where there are tungsten islands at a depths close to the surface, with only a layer thin layer of diamond covering the tungsten islands. There may also be areas 178 where there are tungsten islands at a depth farther from the surface, with a thicker layer of diamond covering the tungsten islands. In this manner, having islands of tungsten 164 (e.g., X-ray generating material) at varying depths throughout the source target may enable greater than 70%, 80%, 90%, or approximately 100% lateral coverage of tungsten 56 as see by an electron beam that may impact the source target 54. Approximately 100% lateral coverage of X-ray generating tungsten 56 may enable maximizing X-ray emission.

The respective fabrication process examples shown in FIGS. 4-7 each depict the formation of a multi-layer source target having particular discretized structures of X-ray generating tungsten. However, it should be appreciated that any of the methods depicted in FIGS. 4-7 may be used in the fabrication of multi-layer source targets containing discretized tungsten in the form of strips, islands, or walls. Further, the methods depicted in FIGS. 4-7 may be used to fabricate source targets with uniform distributions of discretized tungsten in diamond, as well as to fabricate discretized tungsten localized only in certain area(s). Discretized tungsten in only certain area(s) of the source target may allow achieving a small X-ray emission spot regardless of the size of the electron beam. The different arrangements of discretized tungsten (e.g., strips, islands, and walls) in a multi-layer source target may have different lateral coverages in certain embodiments, ranging from approximately 50% to 100% as seen from the direction of electron beam incidence. The lateral feature size of the discretized tungsten in the various depicted arrangements may vary from a few micrometers to tens of micrometers. In certain embodiments, the thickness (in the z-dimension) of the discretized tungsten strips or islands may vary from a few micrometers to tens of micrometers to enable more uniform electron beam absorption and better heat dissipation. In this manner, the thickness of the discretized tungsten strips or islands may increase in thickness at lower depths in the source target, thus enabling a more even distribution of heat.

When using a multi-layer source target having discretized tungsten, as discussed herein, charges 192 resulting from an electron beam 190 impacting the source target may become trapped in the materials (e.g. tungsten and diamond). Conduction of these charges 192 may be achieved through self-breakdown, which occurs mostly along the grain boundaries 196 of the thermally conductive diamond 82 due to structural and chemical weaknesses of the diamond 82 in these areas. Conduction of the charges may also be achieved through a thin conduction layer on the side or top of the source target that contacts and connects all layers together that may take the charges away. Electrical conduction in the diamond 82 may also be achieved by two approaches illustrated in FIGS. 8 and 9.

Figure 8:
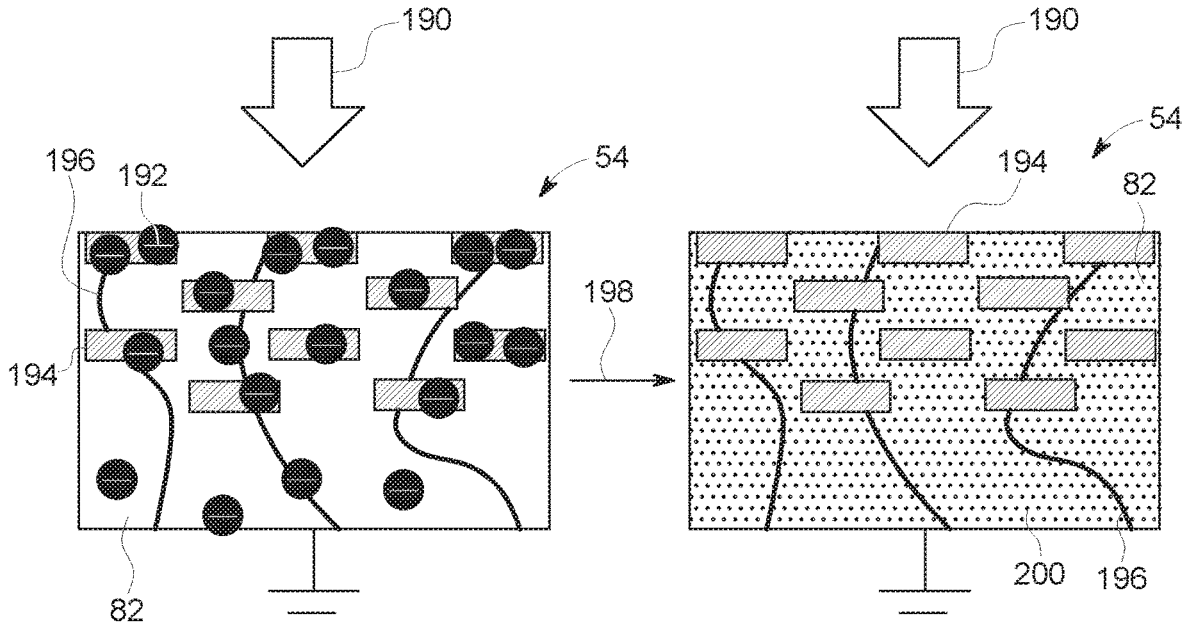
FIG. 8 depicts a process of doping the diamond of a source target, in accordance with aspects of the present disclosure.

FIG. 8 depicts a process of doping the diamond 82 of a multi-layer source target 54 having discretized tungsten islands or strips 194 to make the diamond 82 conductive. When using a multi-layer source target 54 having discretized tungsten, charges resulting from an electron beam 190 impacting the source target may become trapped in the materials (e.g. tungsten and diamond). Conduction of the trapped charges 192 may be achieved by doping 198 the diamond 82 of the source target 54 using a dopant 200 (e.g., boron or graphite). The dopant 200 may be more conductive than the diamond 82, thus rendering the diamond 82 of the source target 54 more conductive. However, the dopant 200 may be less conductive than the diamond 82, but doping of the diamond 82 with such a dopant may render the diamond 82 more conductive. FIG. 8 depicts the doping 198 of the diamond 82 of the source target 54 after fabrication of the multi-layer source target 54 having discretized tungsten strips or islands 194 in diamond 82. However, the diamond 82 may be doped with the dopant (e.g., boron or graphite) before fabrication or at other stages, and the resulting doped diamond may be used in the fabrication steps. Doping the diamond 82 of the multi-layer source target 54 enables more efficient charge dissipation of charges 192 trapped within the target 54.

Figure 9:
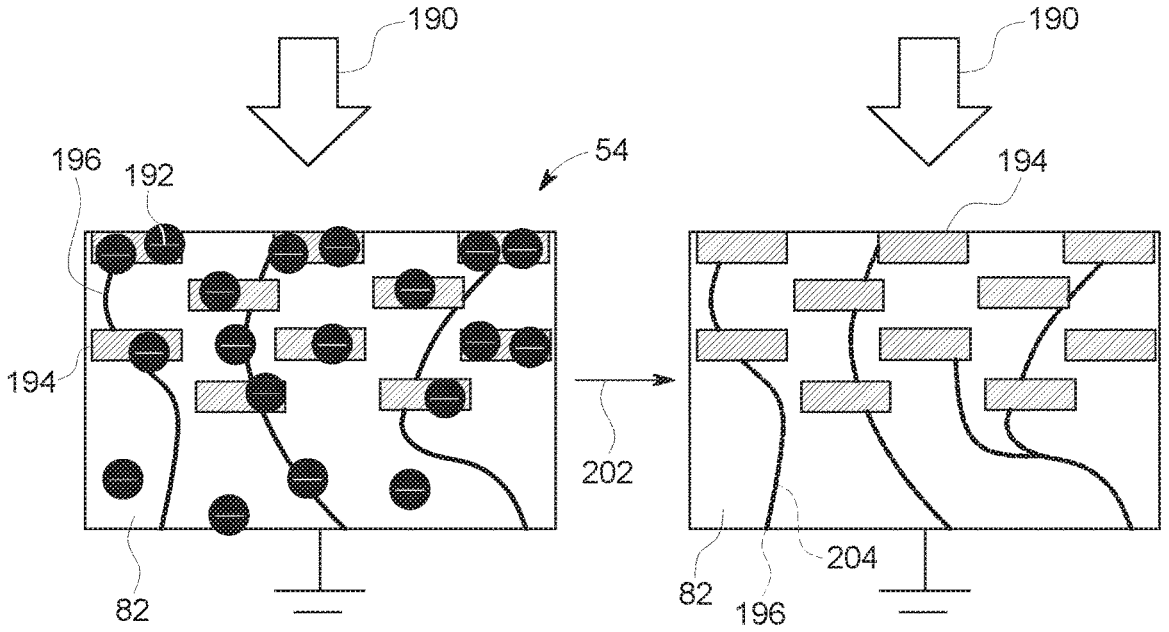
FIG. 9 depicts a process of heat treating the diamond of a source target, in accordance with aspects of the present disclosure.

FIG. 9 depicts another method that may be used to achieve charge dissipation within a multi-layer source target 54. In this example, conduction of the trapped charges 192 may be achieved by utilizing a heat treatment 202 to turn the diamond 82 of the source target 54 to graphite 204 along the grain boundaries 196. Graphite 204 may be more conductive than the diamond 82, thus enabling the diamond 82 of the source target 54 to be more conductive. FIG. 9 depicts the heat treatment 202 being performed on the source target 54 after fabrication of the multi-layer source target 54 having discretized tungsten strips or islands 194 in diamond 82. However, the heat treatment 202 may be performed during the fabrication steps as well. Heat treating the diamond 82 in order to form graphite 204 along the grain boundaries 196 may enable more efficient dissipation of the charges 192 trapped within the target 54 when impacted by the electron beam 190.

Figure 10:
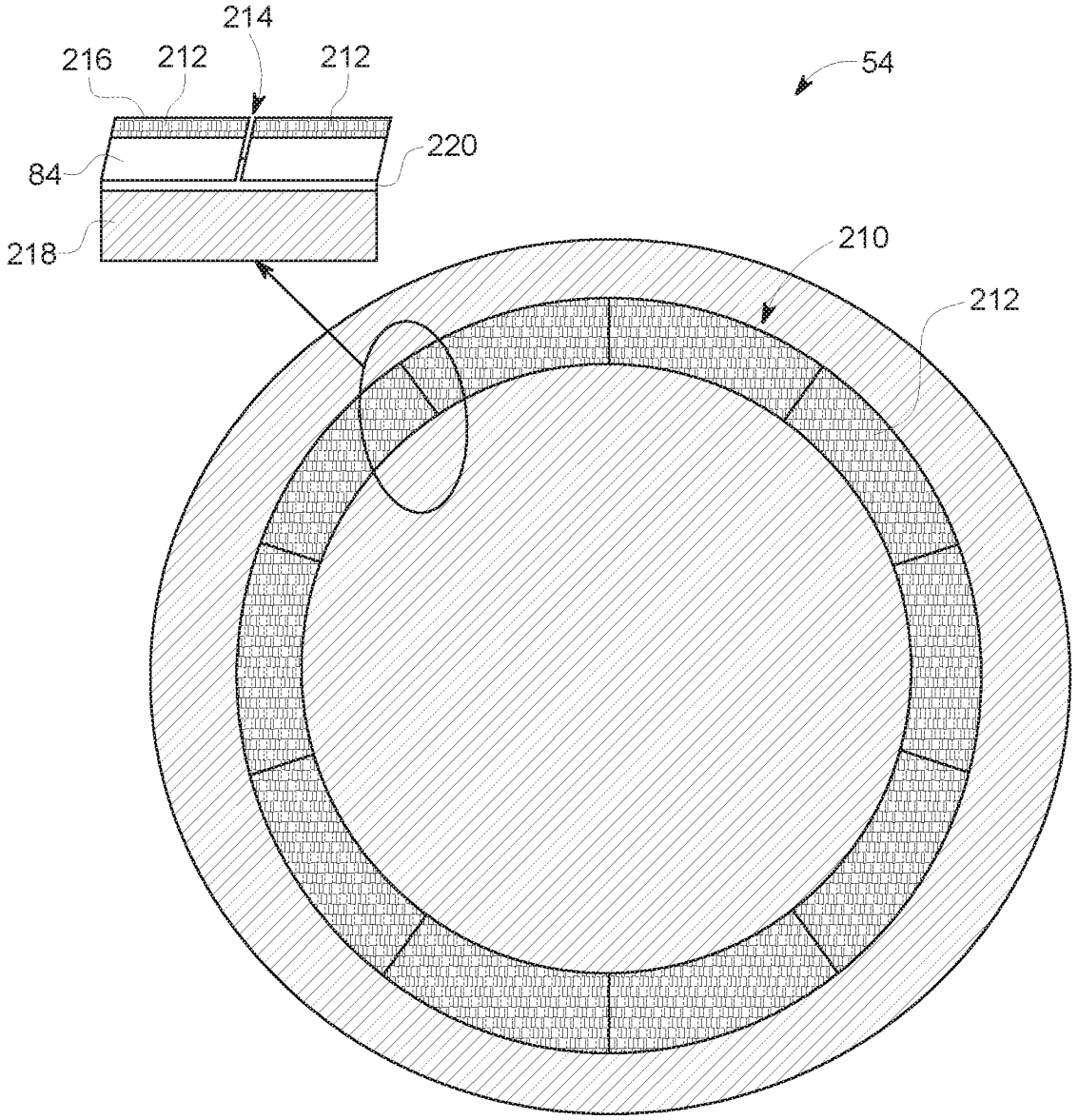
FIG. 10 depicts an assembled rotating X-ray source having a track with multiple pieces of discretized tungsten source target, in accordance with aspects of the present disclosure.

Various assemblies or configurations of the source target 54 may enable more efficient heat dissipation while also maximizing X-ray emission. As discussed herein, the multi-layer source target (i.e., anode) having discretized tungsten in diamond may be a stationary anode, as in FIG. 3, or may be a rotating anode. FIG. 10 depicts an embodiment of a rotating anode having an electron beam track 210 configured from multiple pieces of the discretized tungsten multi-layer source target 54. The source target 54 may have an electron beam track 210 that may be impacted by an electron beam as the source target 54 rotates. The electron beam track 210 may be assembled from individual pieces 212 of the multi-layer source target having discretized tungsten 56 in diamond 82. The source target pieces 212 may be tiled together in a ring formation to form the electron beam track 210 by use of a brazing mat 220. Alignment keys 86 may be used to fit and/or hold the source target pieces 212 together. Between each source target piece 212 of the electron beam track 210 there may be an expansion joint 214 or space to allow for expansion of the source target pieces as they are heated when impacted by an electron beam. The source target pieces 212 may be angled at the edges, such that the electron beam may not go through the expansion joints 214 as it impacts the electron beam track 210 as the source target 54 rotates. Rotation of the source target 54 may help cool the target 54, while the discretized tungsten in diamond may enable further heat dissipation immediately around the electron beam impact area. Further, the use of source target pieces having discretized tungsten 216 (e.g., tungsten strips, islands, or walls in diamond) may enable greater than 70%, 80%, or 90%, or approximately 100% coverage of X-ray generating tungsten 56 on the electron beam track 210 as seen by an electron beam, helping to maximize X-ray emission.

Figure 11:
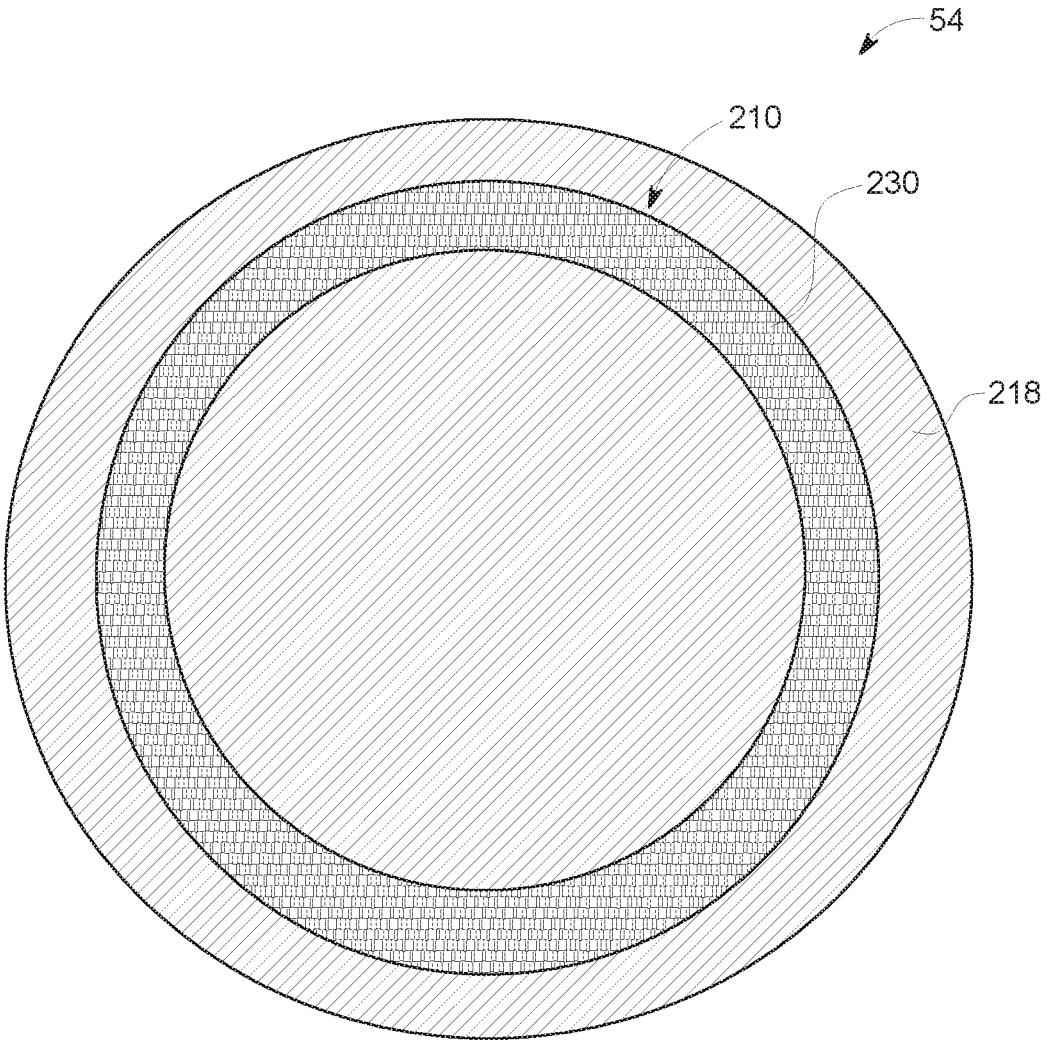
FIG. 11 depicts an assembled rotating X-ray source having a track with a solid ring of discretized tungsten, in accordance with aspects of the present disclosure.

In certain embodiments, a rotating anode source target 54 containing discretized tungsten in diamond may have a solid ring electron beam track 210, as depicted in FIG. 11. The multi-layer source target having discretized tungsten in diamond may be fabricated as a large substrate and subsequently cut into a ring structure to be brazed onto a rotating base 218 of the source target 54, or may be fabricated in a ring structure. Rotation of the source target 54 may help cool the target 54, while the discretized tungsten in diamond may enable further heat dissipation immediately around the electron beam impact area. Further, the use of a source target ring having discretized tungsten 216 (e.g., tungsten strips, islands, or walls in diamond) may enable greater than 70%, 80%, or 90%, or approximately 100% coverage of X-ray generating tungsten 56 on the electron beam track 210 as seen by an electron beam, helping to maximize X-ray emission.

Figure 12:
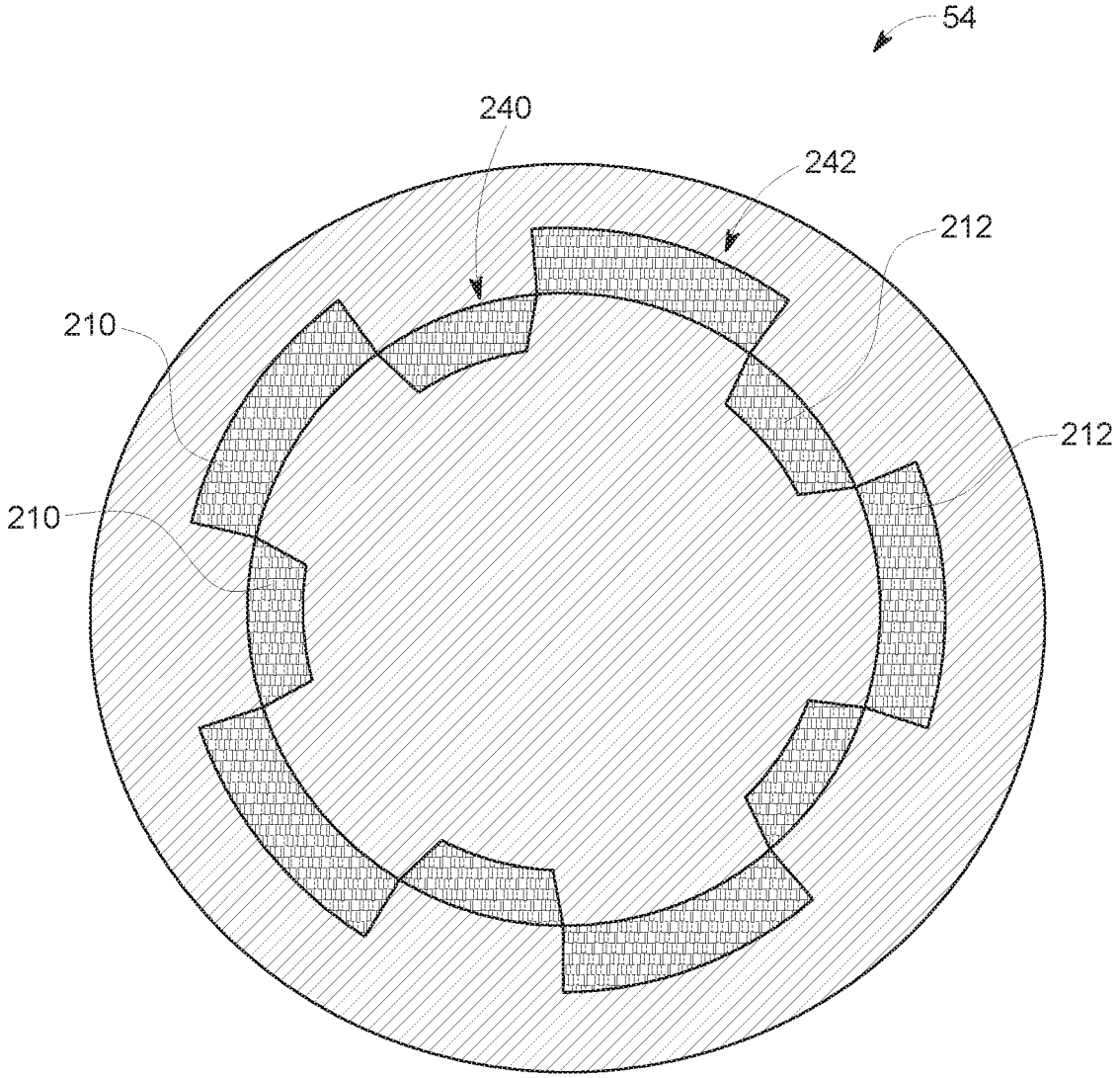
FIG. 12 depicts an assembled rotating X-ray source having a multi-track electron beam track of discretized tungsten in diamond, in accordance with aspects of the present disclosure.

Further, in certain embodiments a rotating anode source target may utilize a multi-track (e.g., staggered) electron beam track 210. FIG. 12 depicts a rotating anode source target 54 having a multi-track electron beam track 210 assembly having a discontinuous inner track 240 alternated with a discontinuous outer track 242. The inner track 240 has a smaller diameter than the outer track 242. Each of the inner track 240 and the outer track 242 of the multi-track electron beam track 210 may be assembled from individual pieces 212 of the multi-layer source target having discretized tungsten 56 in diamond 82. The individual pieces 212 of the multi-layer source target of each track may be separated from the other pieces in each respective inner 240 or outer 242 track. The coverage area of the multi-layer source target pieces 212 of the inner track 240 may not overlap with the coverage area of the multi-layer source target pieces 212 of the outer track 242. In the illustrated embodiment, the multi-track electron beam track 210 has two tracks, the inner track 240 and the outer track 242. However, a rotating anode source target 54 may have more than two staggered tracks that make up the multi-track electron beam track 210.

The use of a multi-track electron beam track 210 as shown in FIG. 12 may facilitate generation of two or more wobbled X-ray spots without moving the electron beam. That is, X-ray generation may be alternated between the inner and outer track as the anode rotates, despite the electron beam maintaining a stationary focus. Rotation of the source target 54 may help cool the target 54, while the discretized tungsten in diamond may enable further heat dissipation immediately around the electron beam impact area. Further, the use of source target pieces having discretized tungsten 216 (e.g., tungsten strips, islands, or walls in diamond) may enable greater than 70%, 80%, or 90%, or approximately 100% coverage of X-ray generating tungsten 56 on a given electron beam track as seen by an electron beam, helping to maximize X-ray emission.

Figure 13:
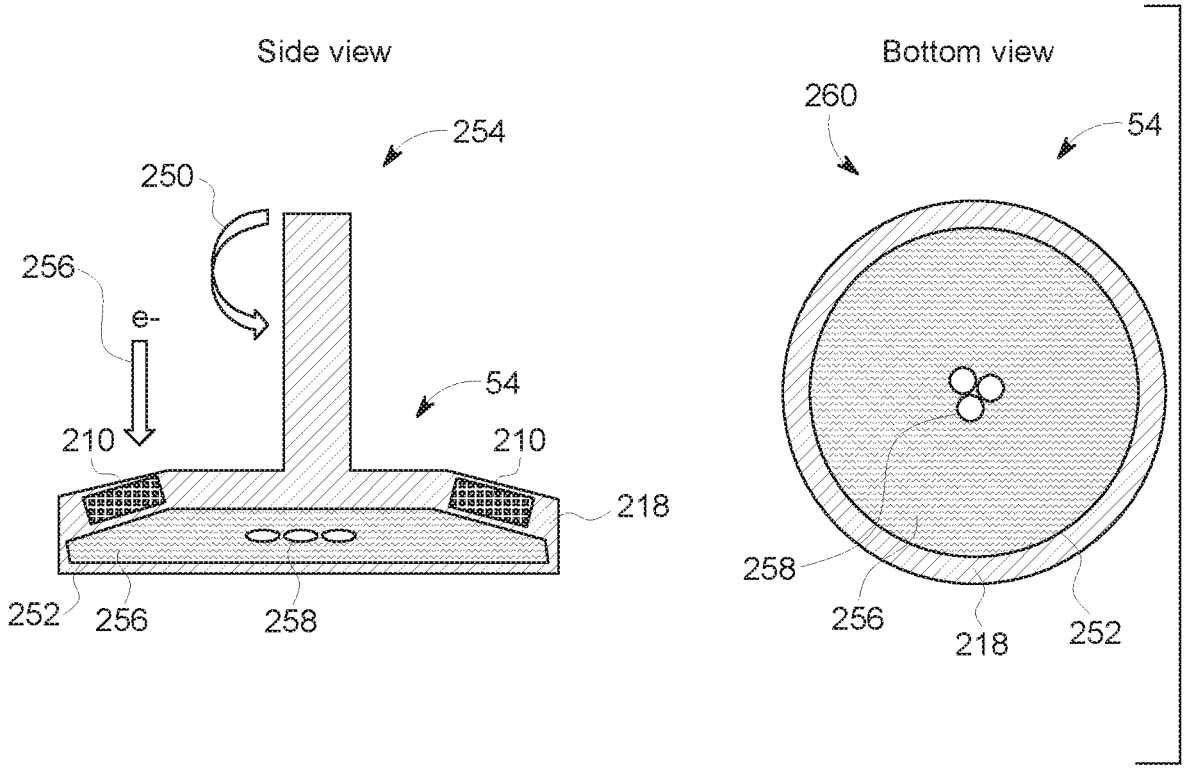
FIG. 13 depicts a rotating X-ray source having an embedded phase changing material underneath the source target track, in accordance with aspects of the present disclosure.

Rotation 250 of a rotating anode may help cool the source target 54. FIG. 13 depicts an approach for providing further heat dissipation in a rotating anode through use of an embedded phase changing material. A phase changing material may be any material, or combination of materials, that may have a melting temperature within a range of approximately 300° C.° to 1200° C.°. This may include materials such as magnesium and alloys, aluminum and alloys, copper and alloys, gold, silver, and many sodium-based compounds. In one such implementation, the rotating anode source target 54 may have a cavity 252 below the electron beam track 210 as illustrated in a side view 254 that may be filled with a liquid and/or phase changing material 256. The phase changing material 256 may be a solid and or a liquid at non-operational temperatures (i.e., temperatures when no electron beam is incident on the electron beam track 210) of the source target 54. The phase changing material 256 may turn from a solid to a liquid, from a solid to a gas, and/or from a liquid to a gas as the target is heated to operational temperatures (i.e., the temperature reached when the electron beam impacts the electron beam track of the source target 54) by an electron beam 256 impacting the electron beam track 210. The electron beam track 210 may contain the multi-layer source target having discretized tungsten in diamond, as discussed herein, or may be of a conventional construction. As the electron beam 256 impacts the source target 54 at the electron beam track 210, the discretized tungsten in diamond may enable more efficient heat dissipation, with some portion of that heat going to heat the liquid and/or phase changing material 256. When heated, the phase changing material 256 disposed in the cavity 252 underneath the electron beam track 210 may turn to a liquid, and thus may freely exchange heat, enabling faster heat dissipation. There may be voids or gas bubbles 258 in the phase changing material 256 filled cavity 252 that may accommodate volume change within the cavity 252 at higher temperatures. As depicted in a bottom view 260, the cavity 252 disposed underneath the electron beam track 210 may be a continuous structure covering most of the area of the base 218 area of the target source 54. In a rotating target, the g-forces generated by the target rotation may provide a driving force for fast convection, with the heated liquid or gas migrating quickly toward the center. The voids or gas bubbles 258 may migrate to and remain in the center, which may enable rotational symmetry, as well as enabling liquid to remain closer to the heat generating track which may be towards the outside of the target.

Technical effects of the invention include providing a multi-layer X-ray source target having discretized tungsten (e.g., X-ray generating material) in diamond (e.g., thermally conductive material) enabling increased heat dissipation in the target immediately around the X-ray generating tungsten. Discretized tungsten in diamond may further enable heat dissipation both laterally and in a downwards direction creating a continuous downward heat path through the diamond. In addition, embedded phase changing material underneath the electron beam track in certain rotating anodes may enable additional heat dissipation. Increased heat dissipation may enable increased X-ray production and/or smaller spot sizes. Increased X-ray production allows for faster scan times for inspection. Further, increased X-ray production would allow one to maintain dose for shorter pulses in the case where object motion causes image blur. Smaller spot sizes allow higher resolution or smaller feature detectability. In addition, the technology increases the throughput and resolution of X-ray inspection, and reduces the cost. Further, the disclosed assemblies of the multi-layer X-ray source target having discretized tungsten in diamond may enable approximately 100% coverage of X-ray generating tungsten on the electron beam track as seen by an electron beam, helping to maximize X-ray emission.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An X-ray source comprising:

a source target configured to generate X-rays when impacted by an electron beam, the source target comprising:

one or more thermally conductive layers; and one or more X-ray generating layers interleaved with the thermally conductive layers, wherein at least one X-ray generating layer comprises discrete regions of X-ray generating material separated by thermally conductive material within the respective X-ray generating layer and the X-ray generating material laterally covers greater than 50% of the source target as seen from the direction from which the electron beam is incident on the source target.

2. The X-ray source of claim 1, wherein the source target is configured to be one of a rotating structure or a stationary structure.

3. The X-ray source of claim 1, wherein the source target is provided as one of a ring structure or a uniform structure.

4. The X-ray source of claim 1, wherein the X-ray generating material comprises one or more of tungsten, molybdenum, titanium-zirconium-molybdenum alloy (TZM), rhodium, tungsten-rhenium alloy, copper-tungsten alloy, chromium, iron, cobalt, copper, silver.

5. The X-ray source of claim 1, wherein the thermally-conductive layers comprise one or more of highly ordered pyrolytic graphite (HOPG), diamond, beryllium oxide, silicon carbide, copper-molybdenum, copper, tungsten-copper alloy, or silver-diamond.

6. The X-ray source of claim 1, wherein the regions of X-ray generating material separated by thermally conductive material within a given X-ray generating layer are formed as stacks of discrete regions of X-ray generating materials, wherein the stacks are angled relative to an underlying substrate surface of the source target.

7. The X-ray source of claim 1, wherein the regions of X-ray generating material separated by thermally conductive material within a given X-ray generating layer comprise one of a wall structure, an island structure, or a strip structure.

8. The X-ray source of claim 1, wherein the thermally-conductive layers have been doped using a dopant so as to be electrically conductive along grain boundaries found within the thermally conductive layers.

9. The X-ray source of claim 1, wherein the thermally-conductive layers have been heat-treated so as to be electrically conductive along grain boundaries found within the thermally conductive layers.

10. The X-ray source of claim 1, wherein the X-ray generating material laterally covers greater than 90% of the of the source target as seen from the direction from which the electron beam is incident on the source target.

11. An X-ray source comprising:

a rotating target structure comprising:

a base; and one or more electron beam target tracks comprising a source target material configured to generate X-rays when impacted by an electron beam, the source target material comprising:

one or more thermally conductive layers; and one or more X-ray generating layers interleaved with the thermally conductive layers, wherein at least one X-ray generating layer comprises discrete regions of X-ray generating material separated by thermally conductive material within the respective X-ray generating layer and the X-ray generating material laterally covers greater than 50% of the source target as seen from the direction from which the electron beam is incident on the source target.

12. The X-ray source of claim 11, wherein the one or more electron beam target tracks comprise a plurality of pieces of the source target material.

13. The X-ray source of claim 12, further comprising expansion joints between the pieces of the plurality of pieces of the source target material.

14. The X-ray source of claim 11, wherein the one or more electron beam target tracks comprise two or more discontinuous electron beam target tracks.

15. The X-ray source of claim 11, wherein the two or more discontinuous electron beam target tracks alternate in their discontinuities such that, in a given radial direction from a center of rotation, only one electron beam target track is present.

16. The X-ray source of claim 11, wherein the X-ray generating material comprises one or more of tungsten, molybdenum, titanium-zirconium-molybdenum alloy (TZM), rhodium, tungsten-rhenium alloy, copper-tungsten alloy, chromium, iron, cobalt, copper, silver.

17. The X-ray source of claim 11, wherein the thermally-conductive layers comprise one or more of highly ordered pyrolytic graphite (HOPG), diamond, beryllium oxide, silicon carbide, copper-molybdenum, copper, tungsten-copper alloy, or silver-diamond.

18. The X-ray source of claim 1, wherein the source target is configured for use in one of a medical, industrial inspection, or an analytical application.

* * * * *